United States Patent [19]

Roldness et al.

[11] 4,287,833

[45] Sep. 8, 1981

[54] AUTO CARRIER RAILWAY CAR

[75] Inventors: David J. Roldness, San Diego; Felixberto A. Galasan, ChulaVista; Thomas H. Watson, Bonita, all of Calif.

[73] Assignee: Pullman Incorporated, Chicago, Ill.

[21] Appl. No.: 77,255

[22] Filed: Sep. 19, 1979

[51] Int. Cl.[3] ..... B61D 19/00; B61D 17/06; B61D 3/02

[52] U.S. Cl. ..... 105/378; 49/199; 49/203

[58] Field of Search ..... 105/377, 378; 410/4, 410/24, 26; 49/142, 197, 199, 200, 203–205; 296/56, 106

[56] References Cited

U.S. PATENT DOCUMENTS

| | | | |
|---|---|---|---|
| 900,491 | 10/1908 | Denton | 49/199 |
| 950,788 | 3/1910 | Williams . | |
| 1,086,602 | 2/1914 | Merker . | |
| 1,721,578 | 7/1929 | Walker | 49/200 |
| 2,217,761 | 10/1940 | McFarlane et al. | 49/200 |
| 2,744,782 | 5/1956 | Backman | 296/56 X |
| 2,869,862 | 1/1959 | Urquhart . | |
| 3,238,995 | 3/1966 | Bonzer | 160/117 |
| 3,464,161 | 9/1969 | Jonsson | 49/197 |
| 3,926,242 | 12/1975 | Lowe | 160/89 |
| 3,947,006 | 3/1976 | Bauer et al. | 296/56 X |
| 4,144,820 | 3/1979 | Jaekle et al. | 105/378 X |

*Primary Examiner*—Randolph A. Reese
*Attorney, Agent, or Firm*—Richard J. Myers

[57] ABSTRACT

A railway car for carrying autos includes a loading end having lower folding and an upper swinging door which is actuated from the lower platform of the car. The upper and lower doors are opened and closed independently to provide a complete closure for loading end.

14 Claims, 8 Drawing Figures

FIG. 1
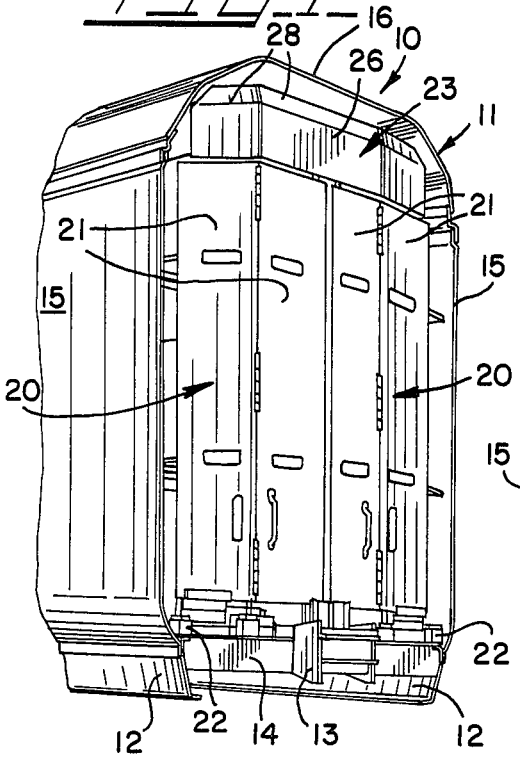
FIG. 2
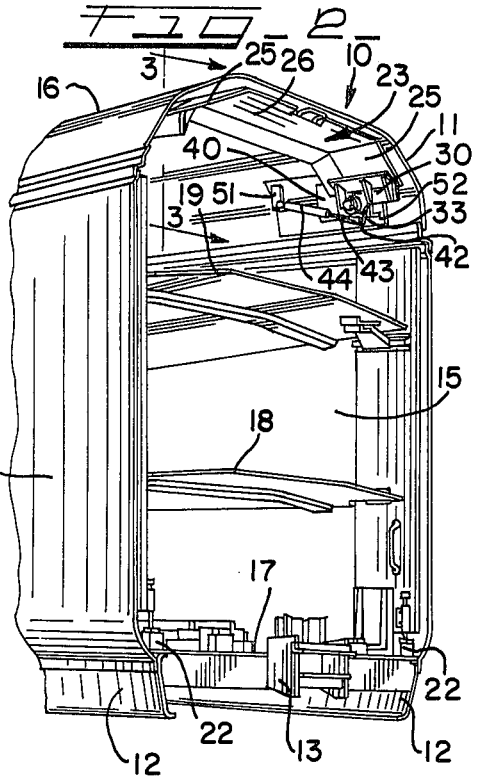
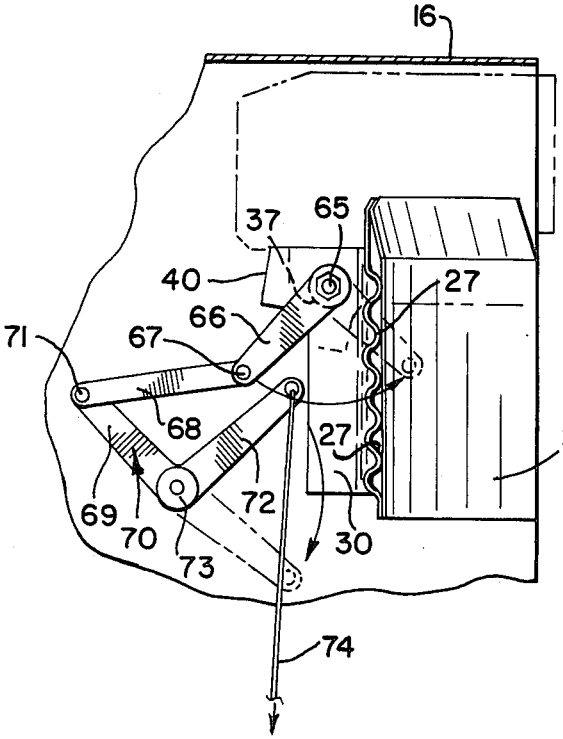
FIG. 7

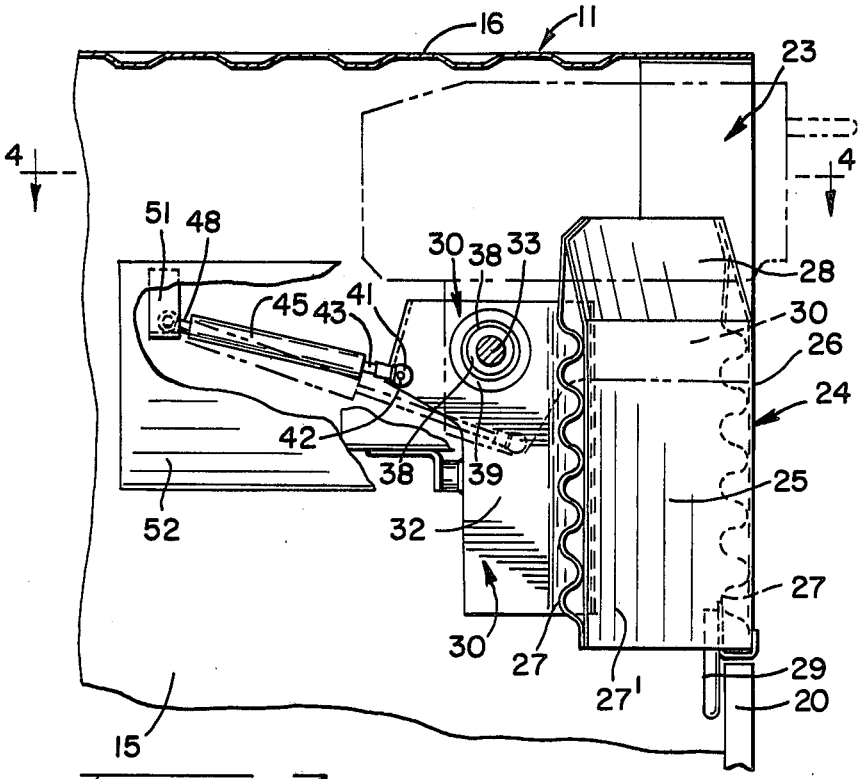
FIG. 3
FIG. 8
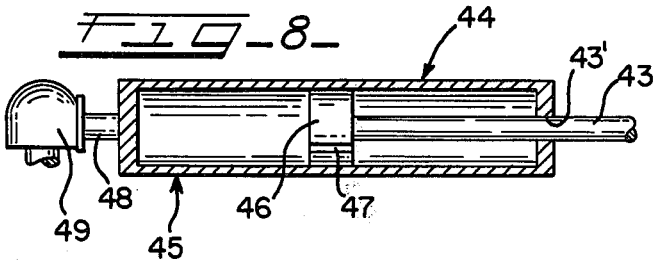
FIG. 4
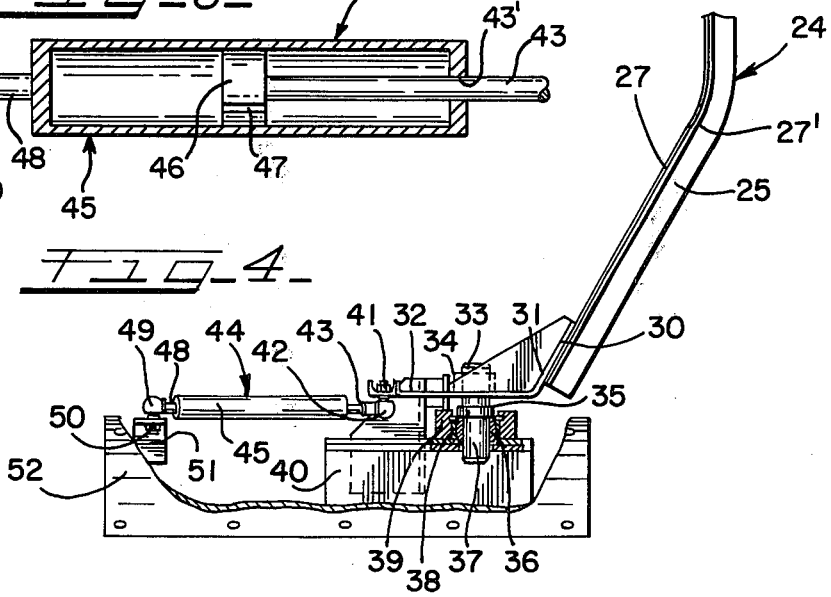

AUTO CARRIER RAILWAY CAR

BACKGROUND OF THE INVENTION

1. Field of the Invention

The present invention relates to railway cars and more specifically to the enclosed type of automobile railway car which comprises a plurality of vertically spaced platforms and a loading end which is ideally suited for the carrying and transporting of the automobiles.

2. Description of the Prior Art

U.S. Pat. Nos. 950,788, patented Mar. 1, 1910 and 1,086,602, patented Feb. 10, 1914 both disclose car doors in the side walls of a railway car. These patents also disclose swinging lower doors and an upper door which is also moved outwardly to form a complete closure. Broadly, thus, these patents disclose a combination door concept but the present invention is an improvement over these patents in that it discloses a completely different type of actuating and operating mechanism for the upper doors of an auto-carrying rail car. U.S. Pat. Nos. 2,869,862, Jan. 20, 1959 and 3,926,242, Dec. 16, 1975 disclose doors which are movable by means of cable mechanisms between open and closed positions. However, neither of these patents show the specific arrangement of the claimed invention which is an improvement over the patents.

SUMMARY OF THE INVENTION

In the present invention a railway car particularly suited for the transport of automobiles includes a plurality of vertically spaced platforms on which automobiles are loaded and transported. In order to provide for protection of the automobile, the railway car is provided with side walls and a roof substantially enclosing the extent of the railway car to prevent damage occasioned by vandalism and also theft. In the present invention the loading end of the car is provided with a plurality of hinged doors which extend substantially to the upper portion of the railway car but are spaced from the roof portion which provides a transverse space closed by an upper hingedly mounted door movable by a suitable mechanism which is actuated from the first or lower level of the railway car. In the preferred embodiment the upper door is stored in an upper recessed position when the lower doors are opened and the railway car is ready for loading or unloading. The upper door is pivoted on the sides of the car by a suitable bracket structure by means of a pair of spherical bearings providing for easy hinging action so that the door can readily and easily be moved between the recessed and closed positions. The door is maintained in the upper recessed open position by means of an extensible device in the form of a conventional gas spring. The gas spring in the stored position of the door has a piston rod fully extended and the piston rod exerts a sufficient force to prevent the door from closing while in transit. When it is desired to close the door the operator standing on or adjacent to the upper platform of the car merely grabs hold of the operating handle and pulls the door downwardly at which time the door descends in a gradual controlled manner by virtue of the dampening action of the gas spring involved.

Another modification provides for raising and lowering the doors by means of a ratchet mechanism and flexible cable associated with the upper door by means of a chain and spring biasing arrangement.

Still a further modification provides for the utilization of a bell crank lever and link or cable element which actuates the door between open and closed positions.

BRIEF DESCRIPTION OF THE DRAWINGS

FIG. 1 is a perspective view of the loading end of an auto rack railway car showing lower and upper doors in a closed position;

FIG. 2 is a view similar to FIG. 1 showing the doors in a open position;

FIG. 3 is a cross-sectional view taken substantially along the line 3—3 of FIG. 2;

FIG. 4 is a cross-sectional view taken substantially along the line 4—4 of FIG. 3;

FIG. 7 is another modification showing a linkage actuating mechanism for moving an upper door between open and closed positions, and FIG. 8 is a cross-sectional view through a gas spring or dampening fluid extensible device of the type utilized in the operation of the preferred embodiment shown in FIGS. 2 and 3.

DESCRIPTION OF THE PREFERRED EMBODIMENT

Figure 5:
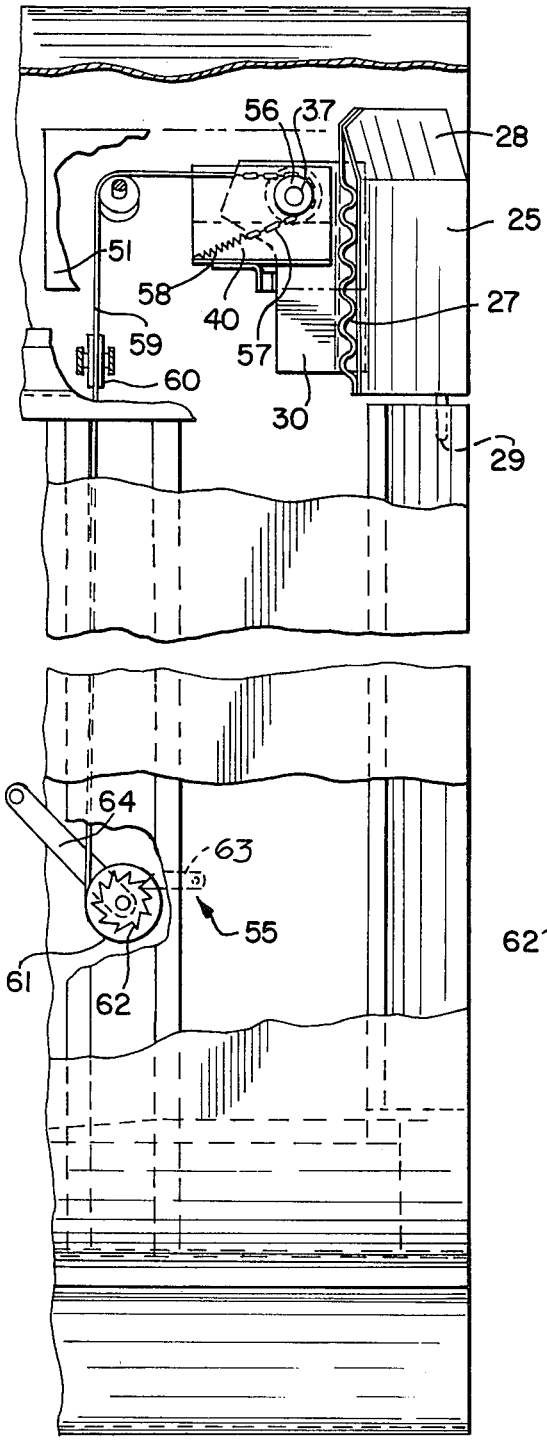
FIG. 5 is a modified view with broken sections of a railway car side disclosing another form of the invention.

FIGS. 1 and 2 disclose a railway car 10 of a type particularly adapted for the transportation of automobiles and the like. The car 10 comprises a car body 11 having at opposite sides thereof lower side sill structures 12 and a center sill and coupler structure generally designated at 13. The center sill and coupler structure 13 is supported on a suitable underframe structure generally designated in 14 and not disclosed in detail. The underframe structure 14 may be of a conventional type having suitably cushioning sill structures for absorbing shocks to which the car may be subjected. Being conventional in design these are not shown in detail. The car body 11 includes upright side walls 15 and a connecting roof structure 16. The body is provided with a lower deck 17, an intermediate deck 18 and an upper deck 19. Each of these decks are provided to support automobiles for transport and one of the loading ends is disclosed in FIGS. 1 and 2 through which the cars are loaded onto the various platforms. At each of the loading ends a vertical end door structure 20 is particularly disclosed in FIG. 1 and this includes a plurality of hinged vertical panels 21 hingedly interconnected in pairs, each pair being pivotally supported at its lower end on hinge structures not shown in the present disclosure. The present application is related to application Ser. No. 027,684 filed Apr. 6, 1979 which discloses in detail the structure and function of the pivotally supported pairs of lower doors for the particular railway car described.

An upper door structure 23 is disclosed which includes a door 24 having diagonal end portions 25 as best shown in FIG. 4 and a central portion 26 connecting the said diagonal end portions 25. The upper door structure 23 includes inner corrugated sheathing 27 to which is connected an outward sheath 27'. The upper ends of the door 23 include inwardly bent upper portions 28 and a handle 29 is connected, as best shown in FIG. 3, to a portion of the door sheathing 27 so that the door may be swung downwardly into a closing position as desired. It will be noted that handle 29 is positionable inwardly of closed end door structure 20 when door 24 is in the closed position, thereby securing the upper door 24 when the lower door structure 20 is closed. As best shown in FIGS. 3 and 4 on each side of the upper door structure 23 a bracket portion 30 includes a diagonal portion 31 connected to opposite sides of the corrugated sheathing 27 and further includes a vertical or longitudinal bracket portion 32 which extends substantially parallel to the side walls 15 of the railway car. A pivot shaft or bearing 33 is rigidly connected to each of the brackets 30 and projects laterally outwardly with respect thereto. A connector sleeve 34, as best shown in FIG. 4, suitably connects each of the parallel bracket portions 32 to the pivot shaft or bearing 33. The shaft 33 is provided with an intermediate ring 35 and is in turn connected to an outwardly projecting cylindrical shaft portion 37. The shaft portion 37 has rigidly supported thereon a spherical bearing 36 which in turn is rotatably journalled in a bearing sleeve 38 in turn supported on a bearing support 39 which is in turn connected to an inner bracket 40 in turn connected to the roof structure and a bracket member 52. Thus the door 24 is adapted to pivot about transverse axes between open and closed positions on the structure described. Further the preferred use of a spherical bearing 36 reduces excessive stress on the door assembly which results due to the longitudinal racking of the railway car.

As best shown in FIG. 4 a ball connection 41 suitably supports a ball on a bracket portion 32. A socket 42 is connected to the ball 41 and in turn is connected to a reciprocating piston rod 43 provided in a spring damper device 44 or as it is sometimes called, a gas spring or extensible device. The spring 44 comprises a cylinder 45, as best shown in FIG. 8 and the piston rod 43 is connected to a piston 46 which reciprocates within the extensible device 44. The piston rod 43 is reciprocating within an opening 43' and at one end of the casing 45 as best shown in FIG. 8. The piston 46 is provided with a pass through orifice 47 communicating with portions of the casing on opposite sides of the piston. A connector portion 48 suitably is connected to a socket member 49 as best shown in FIG. 4 the same in turn being in capturing engagement with a ball and nut connection 50 as best shown in FIG. 4. The ball and nut connection 50 is connected to a bracket 51 in turn suitably supported on the bracket 52.

DESCRIPTION OF MODIFIED EMBODIMENTS

Figure 6:
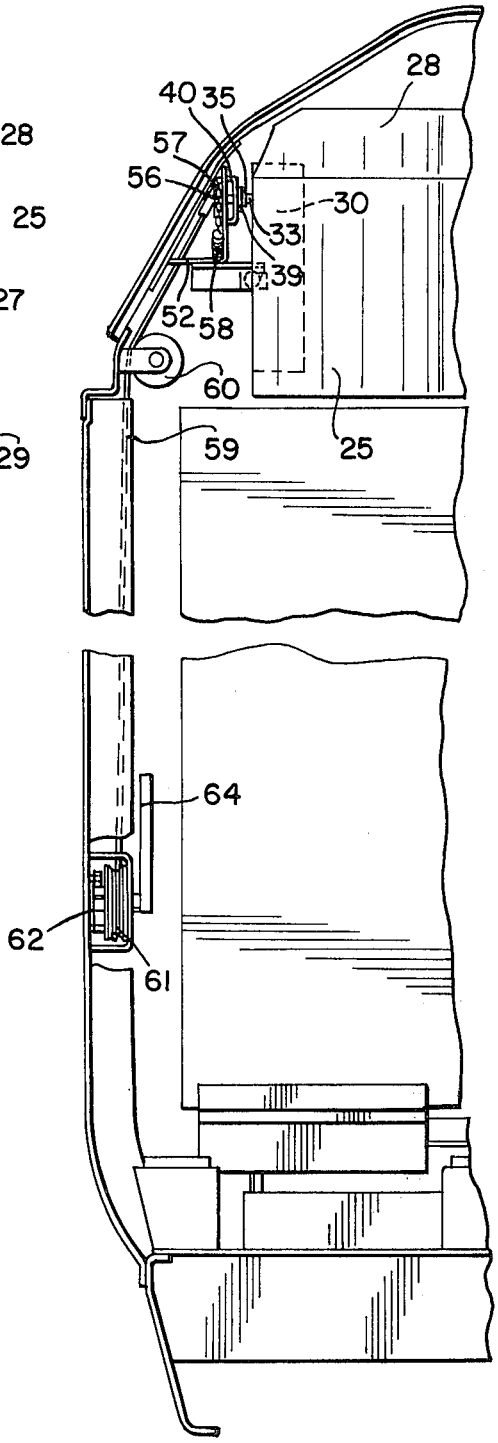
FIG. 6 is an end elevational view of the modification shown in FIG. 5.

FIGS. 5 and 6 disclose another modified arrangement of moving the door 24 between the stored and closed positions. In this particular embodiment the gas spring is omitted and replaced by a rack and pinion actuator generally designated at 55. The arrangement 55 includes a suitable pinion 56 which is fixedly connected to the cylindrical shaft portion 37 and which is rotated by means of a chain section 57 the end of which is connected to a spring 58 connected at an end of the bracket 40. The other end of the chain 57 is connected to a cable 59 which is trained about the guide pulley 60 suitably supported on the side wall of the car, the cable 59 then being wound around a winch pulley 61 connected to a ratchet wheel 62. The ratchet wheel 62 is adapted to engage a pawl 63 for maintaining the same in position. A handle 64 provides for rotation of the ratchet wheel 62 and winch pulley 61.

FIG. 7 discloses another modified form or embodiment for lowering and raising the door 24 between open and closed positions. In this particular modification the cylindrical shaft portion 37 is fixedly secured to a link 66 by means of a bolt and nut connection 65. Thus the link 66 upon rotation provides for rotation of the shaft 37 for the door movement between open and closed positions. Rotation or pivotal movement of the link 66 is provided by a pivot 67 which in turn includes a link 68 connected to a bell crank 70 by means of a pivot 71. The bell crank 70 includes a crank arm 69 connected to a crank arm 72, the bell crank 70, being pivotally supported by pivot means 73 on side wall structure of the car in suitable manner. A cable or link 74 is attached to the crank arm 72 and movement of the cable downwardly causes the bell crank to rotate, and through the linkage arrangement, to move the door 24 between the closed and open positions.

It will be observed in all of the disclosed embodiments that when door 23 is in the open position, it is positioned within the roofline of the car thereby obviating problems of door clearance if the upper door should be open during movement of the car.

Operation

The preferred embodiment of FIGS. 1, 2, 3 and 4 disclose the lower doors which may be moved into the closed position shown in FIG. 1 and into the open recessed positions as shown in FIG. 2. These will be more precisely and specifically described in the aforementioned related patent application. When it is desired to close the upper doors the operator, standing on the lower platform with the utilization of a suitable hook or instrument, or after having positioned himself on or adjacent to the upper deck, grabs the handle 29 and rotates the door 24 from the dotted line position of FIG. 3 to the full line position as indicated. This then is the closed position of the doors and closes the space above the said folding door arrangement. In the upper open position of the door 24 the gas spring 44 serves to maintain the stored position of the door with the piston rod fully extended as shown in the dotted line position of FIG. 3. The gas spring employed is conventional and includes, as best shown in FIGS. 3 and 8 a reciprocating piston 46 which on one side, namely the left side, has a larger surface area than the piston rod side to which the piston 43 is connected. Since the chambers on opposite sides of the piston are filled with pressurized nitrogen gas, the piston normally is moved to its full extension which is the case in the door being maintained in the open position as shown in FIG. 3 (in the broken lines). When the operator desires the door to move downwardly he grasps the handle 29, as indicated previously, pulling down whereupon the door is moved to the full line position shown in FIG. 3 the gas spring at that time providing for a dampening action and door closes at a specified rate as desired. The dampening action is particularly important because of the weight of the door and in this manner is moved to its downward or closed position at a slow and predetermined rate of descent. The spring force is sufficient to keep the door in the up position even when the car is in motion which may be desired under certain circumstances. Thus it is apparent that the door can very easily be moved to its up position and at the same time is very easily lowered at a specified rate, and moved to its closed position.

FIGS. 5 and 6 disclose the rack and pinion actuator which shows the door in FIG. 5 in the closed position.

In this position the cable is not particularly in a taut position but upon rotation of the ratchet wheel 62 and winch pulley 61 the cable is pulled downwardly which in turn causes rotation of the pinion 56 and shaft 37 in a counterclockwise direction moving the door to its open position. During this movement the spring 58 is extended and the tightened cable causes the door to be maintained in the open position and whereupon slow release of the cable tightening upon reversing of the ratchet the door again may move to its closed position.

In FIG. 7 another modified form of the invention is disclosed and it is apparent that by pulling the cable 74 downwardly the bell crank lever 72 provides for movement of the link 66 in a counterclockwise direction whereupon the upper door 24 is also moved to the open position as indicated.

What is claimed is:

1. In a railway car having a body including side walls and a roof structure, said body having at least one open loading end including one or more cargo supporting platforms adapted to be loaded with cargo through said open end, and a door arrangement for said open end including a pair of vertical doors, adapted to be moved between open and closed position, the improvement of an upper door arrangement on said body supported above said vertical doors for closing an upper space disposed between said roof and said vertical doors, comprising door panel means having an outer surface and being pivotally mounted above said vertical doors and movable between a closed position adjacent said vertical doors to an open position away from said vertical doors whereby the outer surface of the door panel means is disposed in a position facing the inside of the car roof structure, supporting means supporting said door panel means solely for rotating movement on said body about a generally horizontal axis extending substantially parallel to and spaced inwardly of said open end of said body, said door panel means being rotatably movable about said supporting means from an open position substantially entirely recessed within said body to a closed position substantially closing said upper space, and operating means connected with said door panel means for moving the same between open and closed positions.

2. The invention in accordance with claim 1, said supporting means including first brackets supported on said side walls, second brackets supported on opposite ends of said door panel means, and bearing elements interconnecting said brackets.

3. The invention in accordance with claim 2, said bearing elements including spherical bearing means thereby accommodating misalignment at said brackets.

4. The invention in accordance with claim 1, said upper door arrangement including biasing means urging said door panel means to its open position.

5. The invention in accordance with claim 4, said operating means comprising handle means mounted on said door panel means.

6. The invention in accordance with claim 5, said handle means being positionable inwardly of said vertical doors when said vertical doors and said door panel means are closed.

7. The invention in accordance with claim 1, said operating means including a pawl and ratchet mechanism supported adjacent to one of said side walls, and flexible means connected to said pawl and ratchet mechanism and to said door panel means whereby said pawl and ratchet mechanism may be actuated to pivot said door panel means to said open position.

8. The invention in accordance with claim 1, said operating means including linkage means supported on one of said walls and connected to said door panel means, and remotely operable tension means connected to said linkage means for opening and closing said door.

9. The invention in accordance with claim 8, said supporting means including shaft and bracket means supported on said side walls and connected to said door panel means for supporting the same about said horizontal axis, said linkage means including a crank arm connected to said shaft and bracket means, and bell crank means pivotally mounted on said body and operatively connected with said crank arm, said tension means being connected to said bell crank means and operable to rotate said door panel means about said horizontal axis.

10. The invention in accordance with claim 1, including first bracket elements supported on said side walls adjacent opposite ends of said door panel means, second bracket elements connected to opposite ends of said door panel means, horizontal shaft means interconnecting said first and second bracket elements, and fluid extensible means connected to said body and to one of said second bracket elements for controlling the pivotal movement of said horizontal door panel between open and closed positions.

11. The invention in accordance with claim 10, said fluid extensible means including means urging said door panel means to an open position.

12. The invention in accordance with claim 11, said fluid extensible means including gas spring means including means for controlling the closing rate of said horizontal door.

13. The invention in accordance with claim 11, said operating means including handle means connected to said door adapted to be actuated by an operator for opening and closing said horizontal door.

14. The invention in accordance with claim 1, wherein said door panel means includes diagonal end portions complemental with the roof structure of the body of the car accommodating recessing of said door panel means within said body when in said open position.

* * * * *